US006621456B2

(12) United States Patent
Ryken et al.

(10) Patent No.: US 6,621,456 B2
(45) Date of Patent: Sep. 16, 2003

(54) MULTIPURPOSE MICROSTRIP ANTENNA FOR USE ON MISSILE

(75) Inventors: Marvin L. Ryken, Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/176,783

(22) Filed: Jun. 24, 2002

(65) Prior Publication Data

US 2003/0076261 A1 Apr. 24, 2003

Related U.S. Application Data

(63) Continuation-in-part of application No. 10/107,343, filed on Mar. 28, 2002, now Pat. No. 6,549,168, which is a continuation-in-part of application No. 10/039,939, filed on Oct. 19, 2001, now Pat. No. 6,466,172.

(51) Int. Cl.[7] ..... H01Q 1/36

(52) U.S. Cl. ..... 343/705; 343/700 MS; 343/846

(58) Field of Search ..... 343/700 MS, 705, 343/725, 853, 846, 829, 815

(56) References Cited

U.S. PATENT DOCUMENTS 6,466,172 B1 * 10/2002 Ryken et al. ..... 343/700 MS
6,549,168 B1 * 4/2003 Ryken et al. ..... 343/700 MS

* cited by examiner

*Primary Examiner*—Tan Ho
(74) *Attorney, Agent, or Firm*—David S. Kalmbaugh

(57) ABSTRACT

A microstrip antenna system having a GPS antenna for receiving GPS data, a telemetry antenna for transmitting telemetry data, a Flight Termination System antenna which receives an RF signal having a set of decoder tones and a beacon tracking antenna for providing an RF signal to allow tracking of the device utilizing the microstrip antenna system. The microstrip antenna system is designed for use on a missile.

20 Claims, 4 Drawing Sheets

MULTIPURPOSE MICROSTRIP ANTENNA FOR USE ON MISSILE

This application is a continuation-in-part of U.S. patent application Ser. No. 10/107,343, filed Mar. 28, 2002 now U.S. Pat. No. 6,549,168, which is a continuation-in-part of U.S. patent application, Ser. No. 10/039,939, filed Oct. 19, 2001 now U.S. Pat No. 6,466,172.

BACKGROUND OF THE INVENTION

1. Field of the Invention

The present invention relates generally to an antenna for use on a missile or the like. More specifically, the present invention relates to a microstrip antenna, designed for use with missiles, which includes a GPS antenna for receiving GPS data, an FTS (Flight Termination System) antenna, a telemetry antenna for transmitting telemetry data, a beacon tracking antenna.

2. Description of the Prior Art

In the past military aircraft and weapons systems such as airplanes, target drones, pods and missiles have included flight termination and beacon tracking antenna to monitor performance during test flights. For example, a missile under test will always have an antenna which is generally surface mounted to transmit telemetry data to a ground station. The ground station then performs an analysis of the telemetry data from the missile to determine its performance during flight while tracking a target.

U.S. Pat. No. 4,356,492 is an example of a prior art microstrip antenna which is adapted for use on a missile as a wrap around band to a missile body without interfering with the aerodynamic design of the missile. U.S. Pat. No. 4,356,492 teaches a plurality of separate radiating elements which operate at widely separated frequencies from a single common input point. The common input point is fed at all the desired frequencies from a single transmission feed line.

With the emerging use of the Global Positioning System (GPS) for tracking purposes, there is a need to include GPS within the instrumentation package for a missile and target drone to accurately measure flight performance. GPS data is extremely accurate and thus allows for a thorough analysis of the missile's performance as well as the target drone's performance in flight while the missile tracks the target drone on a course to intercept the target drone.

The use of satellite provided GPS data to monitor the position of a missile and a drone target in flight will require that an antenna for receiving the GPS data be included in the instrumentation package. The receiving antenna should preferably be mounted on the same dielectric substrate as the transmitting antenna so that the antenna assembly can be applied readily as a wrap around band to the missile body without interfering with the aerodynamic design of the missile. Similarly, the antenna assembly which would include a GPS data receiving antenna and telemetry data transmitting antenna configured as a wrap around band to the projectile's body without interfering with the aerodynamic design of the projectile.

There is also a need for a flight termination system antenna to be included in the missile antenna package in the event that a failure occurs during a missile test flight. A monitoring station can initiate a flight termination action which destroys the missile.

Further, there is a need for a beacon tracking antenna to be included in the missile antenna package which allows a monitoring station to track the flight path of the missile during a test flight.

SUMMARY OF THE INVENTION

The present invention overcomes some of the disadvantages of the past including those mentioned above in that it comprises a relatively simple in design yet highly effective and efficient microstrip antenna assembly which can receive satellite provided GPS position and also transmit telemetry data. The microstrip antenna of the present invention also includes a flight termination system (FTS) antenna and a beacon tracking antenna.

The microstrip antenna comprising the present invention is configured to wrap around the projectile's body without interfering with the aerodynamic design of the projectile.

The antenna assembly of the present invention includes a telemetry antenna mounted on a dielectric substrate. The telemetry antenna transmits telemetry data to ground station or other receiving station. There is a GPS antenna mounted on the dielectric substrate which is physically separated from the telemetry antenna on the dielectric substrate. The GPS antenna is adapted to receive satellite provided GPS position data.

An FTS (Flight Termination System) antenna is also mounted on the dielectric substrate and is physically separated from the GPS and telemetry antennas. The FTS antenna receives a set of decoder tones from an external source and supplies the tones to a flight termination system on board the missile which processes the tones and detonates destruct charges on board the missile destroying the missile. Further, the multipurpose microstrip antenna has a beacon tracking antenna mounted on the dielectric substrate which transmits RF signals allowing a radar at a remote location to track the missile during its flight.

The antenna assembly is a wrap around antenna assembly which fits on the outer surface of a missile, target drone or any other small diameter projectile.

The feed structure for the GPS antenna is mounted on the bottom side of the dielectric substrate and a first plurality of plated through connecting pins electrically connect the antenna receiving elements of the GPS antenna, which are mounted the top side of the dielectric substrate, to the feed structure for the GPS antenna. Similarly, the feed structure for the FTS antenna is mounted on the bottom side of the dielectric substrate and second plurality of plated through connecting pins electrically connect the antenna transmitting elements of the FTS antenna, which are mounted the top side of the dielectric substrate, to the feed structure for the FTS antenna.

The Telemetry antenna includes a plurality of parasitic elements mounted on the top side of the dielectric substrate and a plurality of driven antenna elements and their associated feed structure mounted on the bottom side of the dielectric substrate.

DETAILED DESCRIPTION OF THE PREFERRED EMBODIMENT

Figure 1:
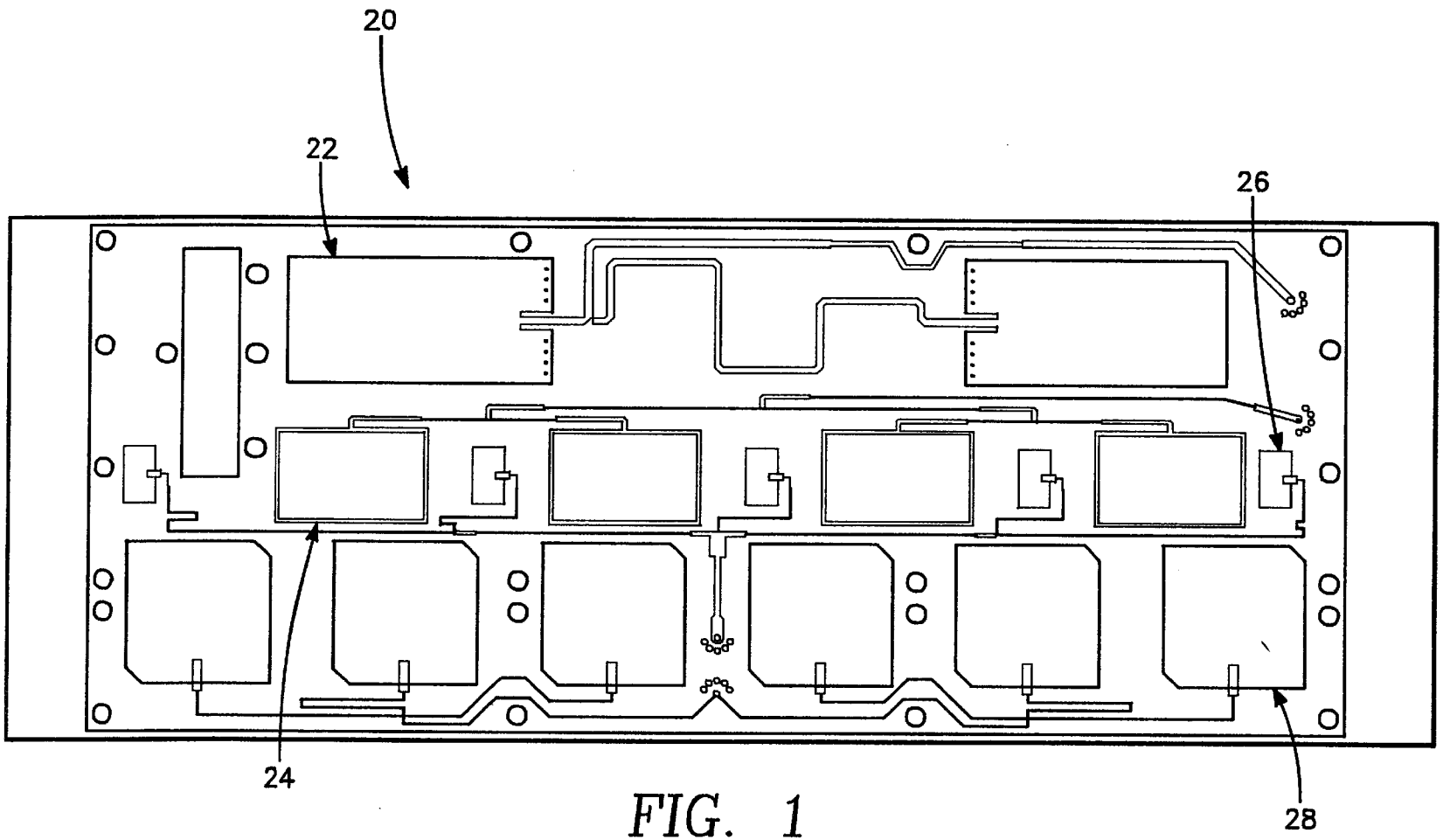
FIG. 1 is a plan view of a preferred embodiment of the multipurpose microstrip antenna comprising the present invention which includes a GPS, an FTS (Flight Termination System), a beacon tracking and a telemetry microstrip antenna mounted on a dielectric substrate.

Referring first to FIG. 1, there is shown a microstrip antenna assembly 20 comprising a flight termination system (FTS) antenna 22, a telemetry antenna 24, a beacon tracking antenna 26 and a GPS (Global Positioning System) antenna 28, for use on small diameter projectiles such as missiles. The antenna 20 has an overall length of 21.475 inches and is designed for a missile having a diameter of the projectile for which antenna assembly 20 is designed is approximately 6.84 inches.

Figure 2A:
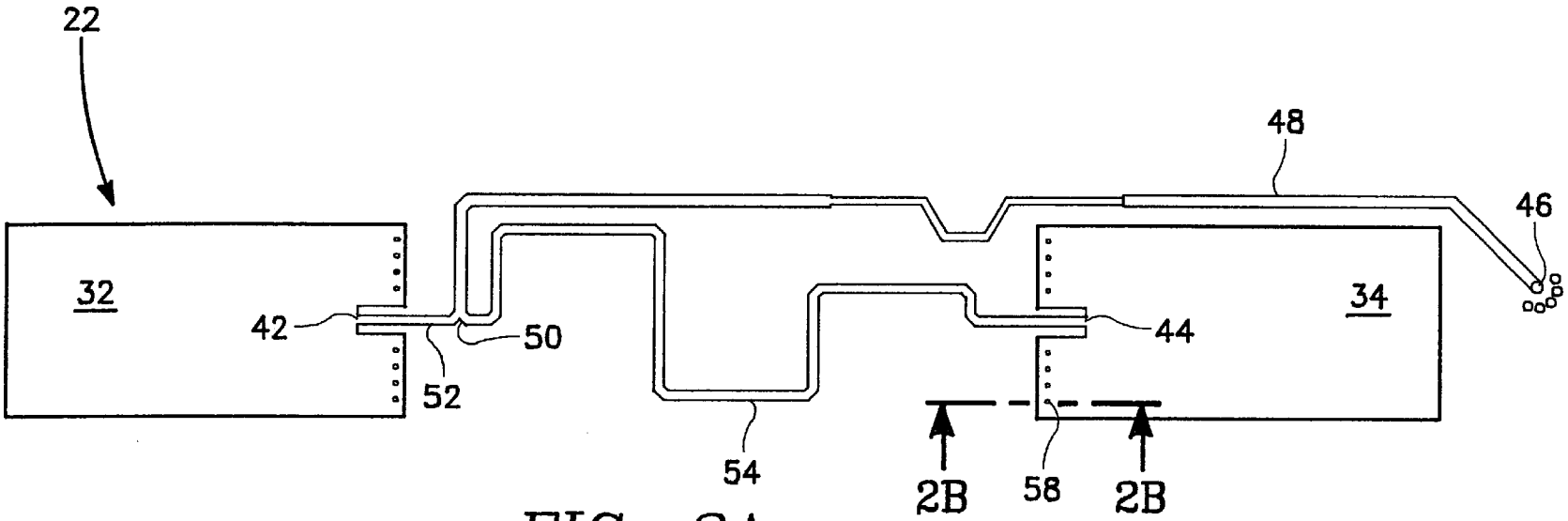
FIGS. 2A and 2B depict, in detail, the FTS antenna for microstrip antenna of FIG. 1.
Figure 2B:
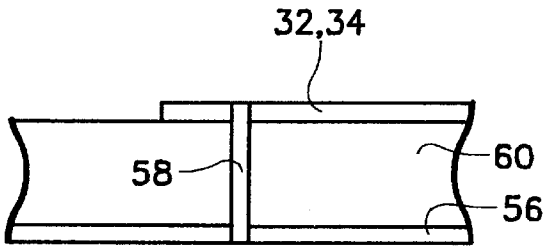

Referring to FIGS. 1, 2A and 2B, there is shown the flight termination system antenna 22 for the microstrip antenna 20 of the present invention. The flight termination system antenna 22 has two separate antenna receiving elements 32 and 34 and operates at a center frequency of 425 megahertz. Each of the receiving elements 32 and 34 are quarter-wave length microstrip antenna elements. The radiating elements 32 and 34 each have a shape which is rectangular and are notch fed respectively via element feed points 42 and 44. The flight termination system antenna 22 includes a single FTS (Flight Termination System) feed point 46, a main microstrip feed line 48 which connects feed point 46 to an electrical junction 50. Extending from junction 50 are branch microstrip feed lines 52 and 54 with branch feed line 52 connecting junction 50 to element feed point 42 and branch feed line 54 connecting junction 50 to element feed point 44.

There is a 180 degree phase shift of the feed line from feed point 46 to receiving element 32 relative to the feed line from feed point 46 to receiving element 34. This insures that the electric field generated by the RF (radio frequency) signal received by elements 32 and 34 of FTS antenna 22 is continuous around the circumference of the missile. The feed point 46 is a 50 ohm impedance and the transmission lines to elements 32 and 34 are sized to match the 50 ohm impedance. The receiving elements 32 and 34 and feed lines 48, 52 and 54 are fabricated from etched copper.

The flight termination antenna 22 receives an RF signal having a set of decoder tones from an external source and supplies the tones to a flight termination system on board the missile which processes the tones and detonates destruct charges on board the missile destroying the missile.

As is best shown in FIG. 2B, one side of each receiving element 32 is electrically connected to the antenna's ground plane 56 by a plurality of copper vias or plated through connecting pins 58. This connection is required because the elements 32 and 34 are quarter-wave length microstrip antenna elements. There is also shown in FIG. 2B a dielectric substrate 60 which has receiving elements 32 and 34 mounted on its upper surface or top side. Dielectric surface is its lower surface or bottom side mounted on ground plane 56.

Referring to FIGS. 1, 3A, 3B and 3C, there is shown a detailed electrical schematic of the telemetry antenna 24 and beacon tracking antenna 26.

Figure 3A:
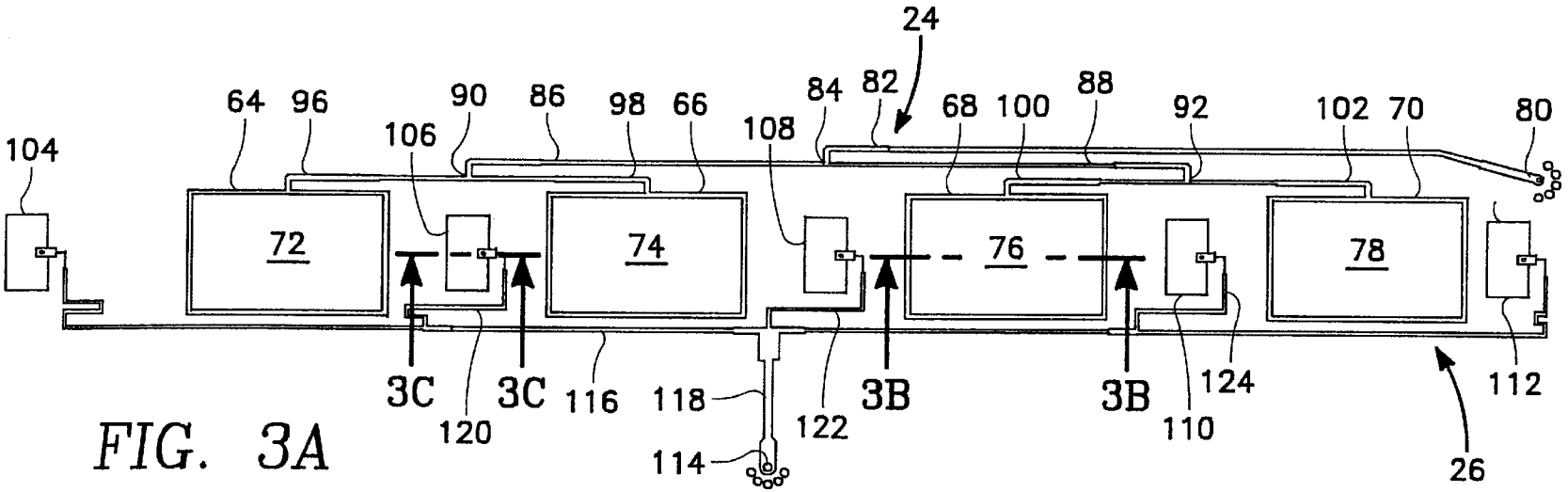
FIGS. 3A, 3B and 3C depict, in detail, the telemetry and the beacon tracking antennas for the microstrip antenna of FIG. 1.
Figure 3C:
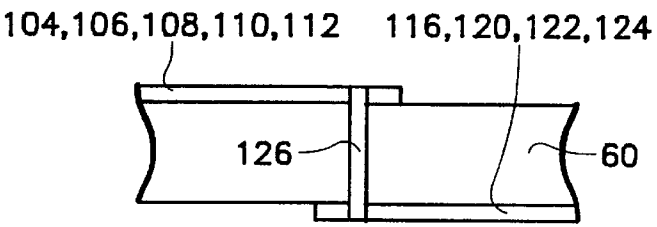
Figure 3B:
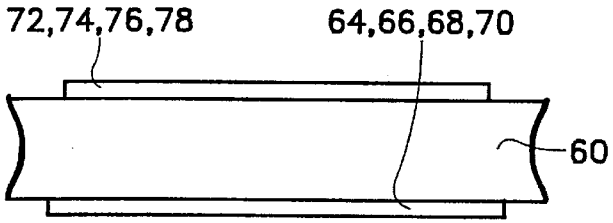
Figure 4:
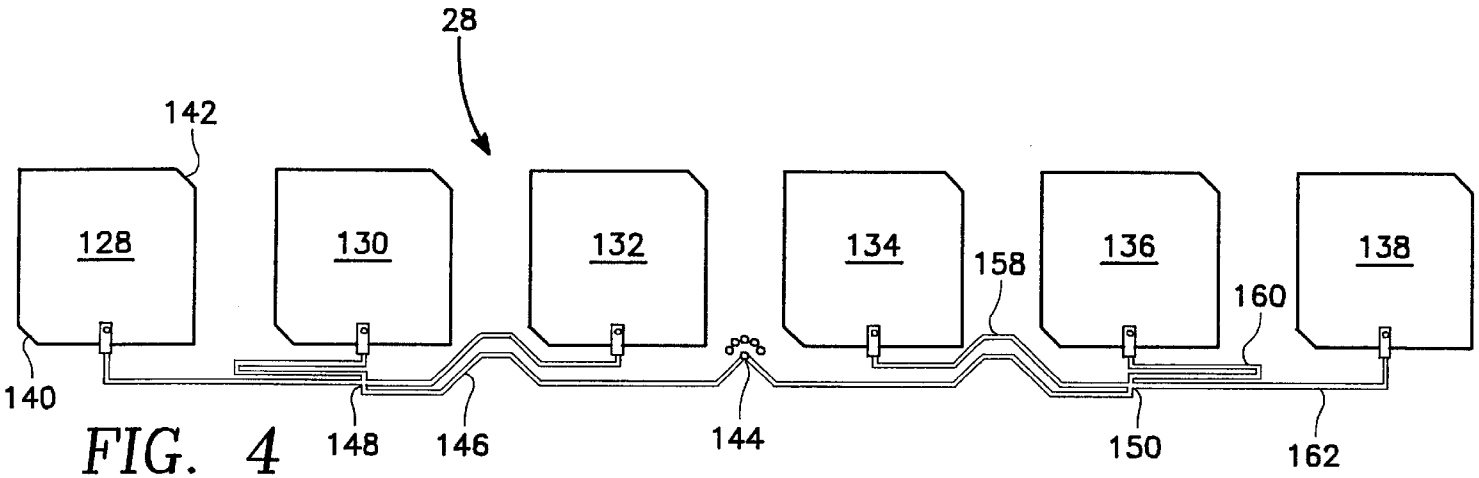
FIGS. 4, 5A and 5B depict, in detail, the GPS antenna for the microstrip antenna of FIG. 1.

Telemetry antenna 26 has an array of four driven elements 64, 66, 68 and 70 and an array of four parasitic elements 72, 74, 76 and 78. The array of four parasitic elements 72, 74, 76 and 78 are mounted on the top side of dielectric substrate 60, while the array of four driven elements 64, 66, 68 and 70 are mounted on the bottom side of dielectric substrate 60 as is best illustrated in FIG. 3B. Each parasitic element 72, 74, 76 and 78 and each driven element 64, 66, 68 and 70 are rectangular in shape with the parasitic elements being slightly smaller than the driven elements of telemetry antenna 24. The combination of the driven elements 64, 66, 68 and 70 and the parasitic elements 72, 74, 76 and 78 of telemetry antenna 24 provides for a broaden bandwidth for telemetry antenna 24 allowing telemetry antenna 24 to operate in the S-Band Frequency range of 2.2–2.3 GHz.

Telemetry antenna 24 also includes a microstrip transmission line structure or feed structure. The feed structure for antenna 24 has a 50 ohm feed point 80. A main feed line 82 electrically connects feed point 80 to an electrical junction 84. Extending from junction 84 is a first pair of branch microstrip feed lines 86 and 88 with branch feed line 52 connecting junction 84 to an electrical junction 90 and branch feed line 88 connecting junction 84 to an electrical junction 92.

Extending from junction 90 is a second pair of branch microstrip feed lines 96 and 98 with branch feed line 96 connecting junction 90 to driven element 64 and branch feed line 98 connecting junction 90 to driven element 66. Extending from junction 92 is a third pair of branch microstrip feed lines 100 and 102 with branch feed line 100 connecting junction 92 to driven element 68 and branch feed line 102 connecting junction 92 to driven element 70. Each of the feed lines 82, 86, 88, 96, 98, 100 and 102 as well as the parasitic elements 72, 74, 76 and 78 and the driven elements 64, 66, 68 and 70 are fabricated from etched copper.

It should be understood that the drawings are only a representation of the invention and that it is critical that each of the feed lines from the driven elements 64, 66, 68 and 70 to the feed point 80 be of exactly the same length to insure an omnidirectional radiation pattern is provided by antenna 24. It should also be noted that the feed structure for telemetry antenna 24 is located on the bottom side of the dielectric substrate on the same plane as the driven elements 64, 66, 68 and 70.

The beacon tracking antenna 26 includes an array of antenna transmitting elements 104, 106, 108, 108 and 112 which operate within the C-band frequency range of 5.4–5.9 GHz. The array of antenna transmitting elements 104, 106, 108, 108 and 112 is mounted on the top side of dielectric substrate 60 (FIG. 3C), while the feed structure for beacon tracking antenna 26 is mounted on the on the bottom side of dielectric substrate 60. The beacon tracking antenna 26 which provides RF signals of equal magnitude and phase allows a radar at a remote site to track the missile's flight path.

The feed structure for antenna 26 includes a 50 ohm feed point 114, a main microstrip feed line 116 and a branch microstrip feed line 118 which electrically connects feed point 114 to feed line 116. One end of feed line 116 connects to antenna element 104, while the other end of feed line 116 connects to antenna element 112. Extending from main feed line 118 is a branch feed line 120 which connects feed line 116 to antenna element 106, a branch feed line 122 which connects feed line 116 to antenna element 108 and a branch feed line 124 which connects feed line 116 to antenna element 110. As is best illustrated in FIG. 3C, each of the antenna transmitting elements 104, 106, 108, 110 and 112 is electrically connected to its associated feed line 116, 120, 122 or 124 by a copper via 126.

The feed structure for beacon tracking antenna 26 is configured as a three way power divider with two units of power being supplied to antenna elements 104 and 106, one unit of power being supplied to antenna element 108 and two units of power being supplied to antenna.

It should be noted that the feed structure for antenna 26 is mounted on the bottom side of the dielectric substrate to allow for substantially narrower feed lines than would be obtainable with a feed structure positioned on the same plane as the antenna elements 104, 106, 108, 110 and 112 of antenna 26. Close proximity of the feed structure of antenna 26 to the ground plane for microstrip antenna assembly 20 allows for the narrow feed lines 116, 120, 122 and 124. The narrow feed lines for the feed structure of antenna are required to provide adequate space to mount the antenna elements of antennas 22, 24, 26 and 28 on the dielectric substrate 60 of microstrip antenna assembly 20.

Referring to FIGS. 1, 4, 5A and 5B, there is shown detailed electrical schematics for the GPS antenna 28 of microstrip antenna assembly 20. The GPS antenna 28, which operates at a frequency of approximately 1575 MHz, includes an array of antenna receiving elements 128, 130, 132, 134, 136 and 138 which are adapted to receive GPS data from a remote source such as a satellite. Since antenna receiving elements 128, 130, 132, 134, 136 and 138 are required to be circularly polarized, opposed corners 140 and 142 of each element 128, 130, 132, 134, 136 and 138 are angled at approximately forty-five degrees. This results in truncated corner patches which allow for excitation of the elements 128, 130, 132, 134, 136 and 138 along their orthogonal axis.

The feed structure for GPS antenna 28 includes a 50 ohm feed point 144 and a main microstrip feed line 146 which connects feed point 144 to a pair of electrical junctions 148 and 150. Extending from electrical junction 148 is a branch feed line 152 which connects feed line 146 to antenna element 128, a branch feed line 154 which connects feed line 146 to antenna element 130 and a branch feed line 156 which connects feed line 146 to antenna element 132. Extending from electrical junction 150 is a branch feed line 158 which connects feed line 146 to antenna element 134, a branch feed line 160 which connects feed line 146 to antenna element 136 and a branch feed line 162 which connects feed line 146 to antenna element 138.

Figure 5A:
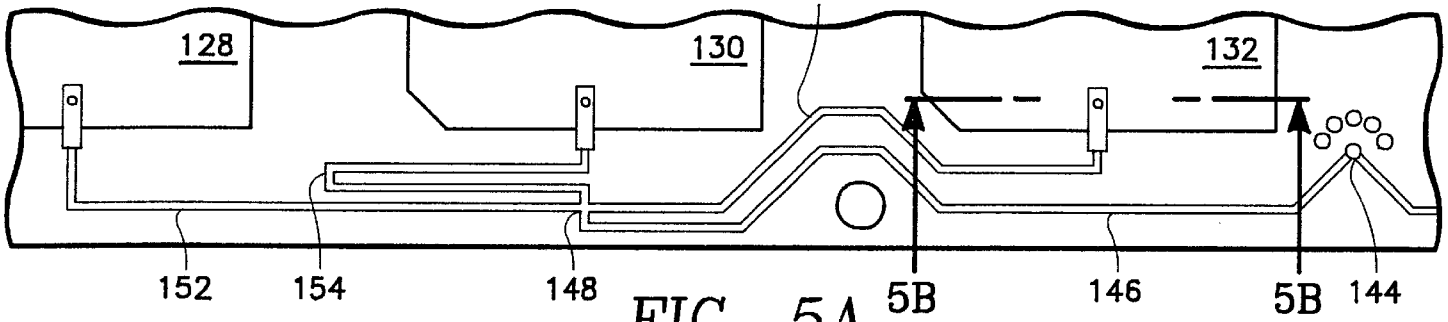
Figure 5B:
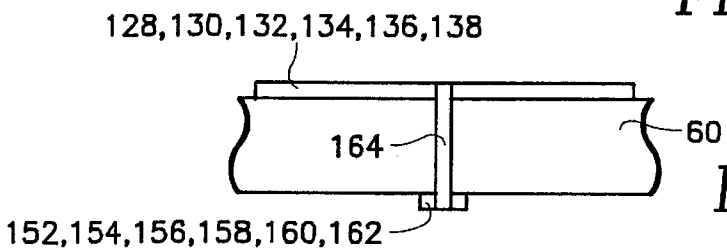

As is best illustrated in FIG. 5B, each of the antenna receiving elements 128, 130, 132, 134, 136 and 138 is electrically connected to its associated feed line 152, 154, 156, 158, 160 or 162 by a copper via or plated through connecting pins 164.

It should be noted that the feed structure for antenna 28 is mounted on the bottom side of the dielectric substrate to allow for substantially narrower feed lines than would be obtainable with a feed structure positioned on the same plane as the antenna elements 128, 130, 132, 134, 136 and 138 of antenna 28. Close proximity of the feed structure of antenna 28 to the ground plane for microstrip antenna assembly 20 allows for the narrow feed lines 146, 152, 154, 156, 158, 160 and 162. The narrow feed lines for the feed structure of antenna are required to provide adequate space to mount the antenna elements of antennas 128, 130, 132, 134, 136 and 138 on the dielectric substrate 60 of microstrip antenna assembly 20.

It should be understood that the drawings are only a representation of the invention and that it is critical that each of the feed lines from the antenna elements 128, 130, 132, 134, 136 and 138 to the feed point 144 be of exactly the same length to insure an omnidirectional radiation pattern is provided by antenna 20.

At this time it should be noted that a flight termination system (FTS) antenna 22, a telemetry antenna 24, a beacon tracking antenna 26 and a GPS (Global Positioning System) antenna 28 are separated physically from one another. Dielectric substrate 60 may be fabricated from a laminate material RT/Duroid 6002 commercially available from Rogers Corporation of Rogers Conn. This material allows sufficient strength and physical and electrical stability to satisfy environmental requirements and is also easily mounted on the surface of a missile or a target drone. The dielectric substrate 60 may be fabricated from two layers of 0.031 inch thick material, and a 0.010 inch thick antenna protective cover board. The use of the multi-layer fabrication to fabricate the substrate is to prevent wrinkling and cracking of the substrate when the dielectric 60 is mounted on the surface of a missile.

From the foregoing, it is readily apparent that the present invention comprises a new, unique, and exceedingly microstrip antenna for use on a missile, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A microstrip antenna system for use on a missile comprising:

a ground plane mounted on and wrapped around an outer circumference of said missile;

a dielectric substrate mounted on said ground plane;

a microstrip flight termination system antenna mounted on said dielectric substrate, said microstrip flight termination system antenna being electrically connected to said ground plane, said microstrip flight termination antenna receiving a first RF (radio frequency) signal;

a microstrip telemetry antenna spaced apart from and electrically separated from said ground plane by said dielectric substrate, said microstrip telemetry antenna being mounted on said dielectric plane, said microstrip telemetry antenna transmitting a second RF signal;

a microstrip GPS (Global Positioning System) antenna spaced apart from and electrically separated from said ground plane by said dielectric substrate, said microstrip telemetry antenna being mounted on said dielectric substrate, said microstrip antenna receiving a third RF signal; and a beacon tracking antenna spaced apart from and electrically separated from said ground plane by said dielectric substrate, said beacon tracking antenna being mounted on said dielectric substrate, said beacon tracking antenna transmitting a fourth RF signal;

said microstrip flight termination system antenna, said microstrip telemetry antenna, said microstrip GPS antenna and said beacon tracking antenna being electrically separated from one another on said dielectric substrate.

2. The microstrip antenna system of claim 1 wherein said first RF signal has a center frequency of about 425 MHz, said first RF signal including a set of decoder tones.

3. The microstrip antenna system of claim 1 wherein said second RF signal is an S-Band radio frequency signal having a frequency range of 2.2 to 2.3 GHz.

4. The microstrip antenna system of claim 1 wherein said third RF signal has a frequency of about 1575 MHz.

5. The microstrip antenna system of claim 1 wherein said fourth RF signal is a C-band radio frequency signal having a frequency range of 5.4 to 5.9 GHz.

6. The microstrip antenna system of claim 1 wherein said microstrip flight termination system antenna comprises:

a single feed input point;

a first antenna receiving element positioned on one side of said missile, said first antenna receiving element having a rectangular shape and a notch feed point, said first antenna receiving element being mounted on said dielectric substrate;

a second antenna receiving element positioned on an opposite side of said missile, said second antenna receiving element having a rectangular shape and a notch feed point, said second antenna receiving element being mounted on said dielectric substrate;

a main feed line having one end connected to said single feed input point;

a first branch feed line having one end connected to the notch feed point of said first antenna receiving element and an opposite end connected to the opposite end of said main feed line;

a second branch feed line having one end connected to the notch feed point of said second antenna receiving element and an opposite end connected to the opposite end of said main feed line; and said second feed line including a plurality of right angle bends which lengthen said second feed line allowing said second feed line to provide for a 180 degree phase shift of said first RF signal when received by said second antenna receiving element, the 180 degree phase shift of said first RF signal insuring that an electric field for said first RF signal is continuous around the outer circumference of said missile.

7. The microstrip antenna system of claim 6 further comprising a plurality of plated through connecting pins which pass through said dielectric substrate to electrically connect said first antenna receiving element and said second antenna receiving element to said ground plane, each of said plated through connecting pins having one end connected to said ground plane and the opposite end connected to said first antenna receiving element or said second antenna receiving element.

8. The microstrip antenna system of claim 1 wherein said microstrip telemetry antenna comprises:

an S-band feed point;

a first antenna array having a plurality of driven antenna elements mounted on a bottom surface of said dielectric substrate around the outer circumference of said missile, said driven antenna elements being electrically separated from said ground plane;

a second antenna array having a plurality of parasitic elements mounted on an upper surface of said dielectric substrate around the outer circumference of said missile, said plurality of parasitic elements being electrically separated from said ground plane, said first antenna array being spaced apart from said second antenna array by said dielectric substrate; and a feed structure connecting each of said plurality of driven antenna elements to said S-band feed point.

9. The microstrip antenna system of claim 8 wherein the combination of said plurality of driven antenna elements and said plurality of parasitic elements allow said telemetry antenna to operate over an S-Band Frequency range of 2.2 to 2.3 GHz.

10. The microstrip antenna structure of claim 1 wherein said beacon tracking antenna comprises:

a C-band feed point;

an antenna array having a plurality of antenna transmitting elements, said antenna transmitting elements being mounted on an upper surface of said dielectric substrate around the outer circumference of said missile, said antenna transmitting elements being electrically separated from said ground plane;

a feed structure mounted on a bottom surface of said dielectric substrate, said feed structure being connected to said C-band feed point; and a plurality of plated through connecting pins which pass through said dielectric substrate to electrically connect each of said plurality of antenna transmitting elements to said feed structure, each of said plated through connecting pins having one end connected to said feed structure and the opposite end connected to one of said plurality of antenna transmitting elements.

11. The microstrip antenna structure of claim 1 wherein said microstrip GPS antenna comprises:

a 50 ohm feed point;

a GPS antenna array having a plurality of antenna receiving elements, said antenna receiving elements being mounted on an upper surface of said dielectric substrate around the outer circumference of said missile, said antenna receiving antenna elements being electrically separated from said ground plane;

a feed structure mounted on a bottom surface of said dielectric substrate, said feed structure being connected to said 50 ohm feed point; and a plurality of plated through connecting pins which pass through said dielectric substrate to electrically connect each of said plurality of antenna receiving elements to said feed structure, each of said plated through connecting pins having one end connected to said feed structure and the opposite end connected to one of said plurality of antenna receiving elements.

12. The microstrip antenna system of claim 1 wherein said microstrip flight termination system antenna, said microstrip telemetry antenna, said microstrip GPS antenna and said beacon tracking antenna are each fabricated from etched copper.

13. A microstrip antenna system for use on a missile comprising:

a ground plane mounted on and wrapped around an outer circumference of said missile;

a dielectric substrate mounted on said ground plane;

a microstrip flight termination system antenna mounted on said dielectric substrate, said microstrip flight termination system antenna being electrically connected to said ground plane, said microstrip flight termination antenna receiving a first RF (radio frequency) signal, said first RF signal having a center frequency of about 425 MHz;

a microstrip telemetry antenna spaced apart from and electrically separated from said ground plane by said dielectric substrate, said microstrip telemetry antenna being mounted on said dielectric substrate, said microstrip telemetry antenna transmitting a second RF signal, said second RF signal being an S-Band radio frequency signal having a frequency range of 2.2 to 2.3 GHz;

a microstrip GPS (Global Positioning System) antenna spaced apart from and electrically separated from said ground plane by said dielectric substrate, said microstrip telemetry antenna being mounted on said dielectric substrate, said microstrip antenna receiving a third RF signal, said third RF signal having a frequency of about 1575 MHz; and a beacon tracking antenna spaced apart from and electrically separated from said ground plane by said dielectric substrate, said beacon tracking antenna being mounted on said ground plane, said beacon tracking antenna transmitting a fourth RF signal being an S-band radio frequency signal having a frequency range of 5.4 to 5.9 GHz;

said microstrip flight termination system antenna, said microstrip telemetry antenna, said microstrip GPS antenna and said beacon tracking antenna being electrically separated from one another on said dielectric substrate.

14. The microstrip antenna system of claim 13 wherein said microstrip flight termination system antenna comprises:

a single feed input point;

a first antenna receiving element positioned on one side of said missile, said first antenna receiving element having a rectangular shape and a notch feed point;

a second antenna receiving element positioned on an opposite side of said missile, said second antenna receiving element having a rectangular shape and a notch feed point;

a main feed line having one end connected to said single feed input point;

a first branch feed line having one end connected to the notch feed point of said first antenna receiving element and an opposite end connected to the opposite end of said main feed line;

a second branch feed line having one end connected to the notch feed point of said second antenna receiving element and an opposite end connected to the opposite end of said main feed line; and said second feed line including a plurality of right angle bends which lengthen said second feed line allowing said second feed line to provide for a 180 degree phase shift of said first RF signal when received by said second antenna receiving element, the 180 degree phase shift of said first RF signal insuring that an electric field for said first RF signal is continuous around the outer circumference of said missile.

15. The microstrip antenna system of claim 14 further comprising a plurality of plated through connecting pins which pass through said dielectric substrate to electrically connect said first antenna receiving element and said second antenna receiving element to said ground plane, each of said plated through connecting pins having one end connected to said ground plane and the opposite end connected to said first antenna receiving element or said second antenna receiving element.

16. The microstrip antenna system of claim 13 wherein said beacon tracking antenna comprises:

an S-band feed point;

a first antenna array having a plurality of driven antenna elements mounted on a bottom surface of said dielectric substrate around the outer circumference of said missile, said driven antenna elements being electrically separated from said ground plane;

a second antenna array having a plurality of parasitic elements mounted on an upper surface of said dielectric substrate around the outer circumference of said missile, said parasitic elements being electrically separated from said ground plane, said first antenna array being spaced apart from said second antenna array by said dielectric substrate; and a feed structure connecting each of said plurality of driven antenna elements to said S-band feed point.

17. The microstrip antenna system of claim 13 wherein the combination of said plurality of driven antenna elements and said plurality of parasitic elements allow said telemetry antenna to operate over an S-Band Frequency range of 2.2 to 2.3 GHz.

18. The microstrip antenna structure of claim 13 wherein said microstrip GPS antenna comprises:

a C-band feed point;

an antenna array having a plurality of antenna transmitting elements, said antenna transmitting elements being mounted on an upper surface of said dielectric substrate around the outer circumference of said missile, said antenna transmitting elements being electrically separated from said ground plane;

a feed structure mounted on a bottom surface of said dielectric substrate, said feed structure being connected to said C-band feed point; and a plurality of plated through connecting pins which pass through said dielectric substrate to electrically connect each of said plurality of antenna transmitting elements to said feed structure, each of said plated through connecting pins having one end connected to said feed structure and the opposite end connected to one of said plurality of antenna transmitting elements.

19. The microstrip antenna structure of claim 13 wherein said microstrip GPS antenna comprises:

a 50 ohm feed point;

a GPS antenna array having a plurality of antenna receiving elements, said antenna receiving elements being mounted on an upper surface of said dielectric substrate around the outer circumference of said missile, said plurality of antenna receiving elements being electrically separated from said ground plane;

a feed structure mounted on a bottom surface of said dielectric substrate, said feed structure being connected to said 50 ohm feed point; and a plurality of plated through connecting pins which pass through said dielectric substrate to electrically connect each of said plurality of antenna receiving elements to said feed structure, each of said plated through connecting pins having one end connected to said feed structure and the opposite end connected to one of plurality of antenna receiving elements.

20. A microstrip antenna system for use on a missile comprising:

(a) a ground plane mounted on and wrapped around an outer circumference of said missile;

(b) a dielectric substrate mounted on said ground plane;

(c) a microstrip FTS (flight termination system) antenna mounted on said dielectric substrate, said microstrip flight termination system antenna being electrically connected to said ground plane, said microstrip flight termination antenna receiving a first RF (radio frequency) signal, said microstrip, said microstrip flight termination system antenna including:

(i) first and second FTS antenna receiving elements mounted on an upper surface of said dielectric substrate on opposite sides of said missile;

(ii) an FTS antenna feed structure mounted on the upper surface of said dielectric substrate, said FTS antenna feed structure being electrically connected to said first and second antenna receiving elements; and (iii) a first plurality of plated through connecting pins which pass through said dielectric substrate to electrically connect said ground plane to said first and second FTS antenna receiving elements;

(d) a microstrip telemetry antenna spaced apart from and electrically separated from said ground plane by said dielectric substrate, said microstrip telemetry antenna being mounted on said dielectric substrate, said microstrip telemetry antenna transmitting a second RF signal, said microstrip telemetry antenna including:

(i) an S-band feed point;

(ii) a first antenna array having a plurality of driven antenna elements mounted on a bottom surface of said dielectric substrate around the outer circumference of said missile, said plurality of driven antenna elements being electrically separated from said ground plane;

(iii) a second antenna array having a plurality of parasitic elements mounted on an upper surface of said dielectric substrate around the outer circumference of said missile, said plurality of driven antenna elements being electrically separated from said ground plane, said first antenna array being spaced apart from said second antenna array by said dielectric substrate; and (iv) a telemetry antenna feed structure connecting each of said plurality of driven antenna elements to said S-band feed point;

(e) a microstrip GPS (Global Positioning System) antenna spaced apart from and electrically separated from said ground plane by said dielectric substrate, said microstrip telemetry antenna being mounted on said dielectric substrate, said microstrip antenna receiving a third RF signal, said microstrip GPS antenna including:

(i) a GPS antenna feed point;

(ii) a GPS antenna array having a plurality of GPS antenna receiving elements, said GPS antenna receiving elements being mounted on an upper surface of said dielectric substrate around the outer circumference of said missile, said plurality of GPS antenna receiving antenna elements being electrically separated from said ground plane;

(iii) a GPS antenna feed structure mounted on a bottom surface of said dielectric substrate, said GPS antenna feed structure being connected to said GPS antenna feed point;

(iv) a second plurality of plated through connecting pins which pass through said dielectric substrate to electrically connect each of said plurality of GPS antenna receiving elements to said GPS antenna feed structure;

(f) a beacon tracking antenna spaced apart from and electrically separated from said ground plane by said dielectric substrate, said beacon tracking antenna being mounted on said dielectric substrate, said beacon tracking antenna transmitting a fourth RF signal, said beacon tracking antenna including:

(i) a C-band feed point;

(ii) a third antenna array having a plurality of beacon tracking antenna transmitting elements, said beacon tracking antenna transmitting elements being mounted on an upper surface of said dielectric substrate around the outer circumference of said missile, said beacon tracking antenna transmitting elements being electrically separated from said ground plane;

(iii) a beacon tracking antenna feed structure mounted on a bottom surface of said dielectric substrate, said feed structure being connected to said C-band feed point; and (iv) a third plurality of plated through connecting pins which pass through said dielectric substrate to electrically connect each of said plurality of beacon tracking antenna transmitting elements to said beacon tracking antenna feed structure; and (h) said microstrip flight termination system antenna, said microstrip telemetry antenna, said microstrip GPS antenna and said beacon tracking antenna being electrically separated from one another on said dielectric substrate.

* * * * *